US010927613B2

(12) United States Patent
Rafie et al.

(10) Patent No.: US 10,927,613 B2
(45) Date of Patent: Feb. 23, 2021

(54) ARTICULATING WIRELINE COMPONENT

(71) Applicants: Saeed Rafie, Houston, TX (US); Richard Bailey, The Woodlands, TX (US)

(72) Inventors: Saeed Rafie, Houston, TX (US); Richard Bailey, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 284 days.

(21) Appl. No.: 15/678,668

(22) Filed: Aug. 16, 2017

(65) Prior Publication Data

US 2019/0055793 A1 Feb. 21, 2019

(51) Int. Cl.

| | |
|---|---|
| ***E21B 17/20*** | (2006.01) |
| ***E21B 17/02*** | (2006.01) |
| *E21B 23/14* | (2006.01) |

(52) U.S. Cl.

CPC ..... *E21B 17/20* (2013.01); *E21B 17/023* (2013.01); *E21B 23/14* (2013.01)

(58) Field of Classification Search

CPC ..... E21B 17/20; E21B 17/023; E21B 31/00; E21B 23/14

See application file for complete search history.

(56) References Cited

U.S. PATENT DOCUMENTS

| | | | | |
|---|---|---|---|---|
| 2,285,213 | A * | 6/1942 | Le Bus | E21B 31/14 285/118 |
| 4,320,983 | A * | 3/1982 | Urasaki | F16C 11/0633 403/139 |
| 5,547,032 | A | 8/1996 | Wenzel | |
| 5,727,641 | A * | 3/1998 | Eddison | E21B 7/068 175/76 |
| 2005/0211444 | A1* | 9/2005 | Kauffman | E21B 17/05 166/380 |
| 2013/0014957 | A1* | 1/2013 | Hallundbæk | E21B 4/18 166/381 |
| 2014/0367169 | A1* | 12/2014 | Wheaten | E21B 23/14 175/45 |
| 2016/0258228 | A1* | 9/2016 | Thomas | E21B 17/20 |
| 2017/0209329 | A1* | 7/2017 | Ishibashi | F16C 11/0614 |

FOREIGN PATENT DOCUMENTS

| | | | |
|---|---|---|---|
| WO | 2012168702 | A1 | 12/2012 |
| WO | 2016032868 | A1 | 3/2016 |

OTHER PUBLICATIONS

Notification of Transmittal of the International Search Report and the Written Opinion of the International Searching Authority,PCT/IB2018/056178; dated Dec. 11, 2018; 15 pages.

* cited by examiner

*Primary Examiner* — Christopher J Sebesta

(74) *Attorney, Agent, or Firm* — Cantor Colburn LLP

(57) ABSTRACT

An articulating wireline component includes a first integrally formed member having a base portion, a neck portion and a ball portion having a first diameter, and a second integrally formed member including a base section, a neck portion and a socket portion including an opening having a second diameter that is smaller than the first diameter. The ball portion is arranged in the socket portion and the second integrally formed member is formed from a solid material.

13 Claims, 5 Drawing Sheets

ARTICULATING WIRELINE COMPONENT

BACKGROUND

Resource exploration and recovery systems rely on a number of downhole devices and sensors to search for and recover resources such as formation fluids. Downhole devices may include pumps, valves, motors, sensors and the like. In some cases, the downhole devices may be operated, activated, and/or manipulated with mechanical tools such as coil tubing. In other cases, the downhole devices may be operated, activated and/or monitored through electrical or optical signals using wireline cables. In general, sensors, devices and auxiliary components that employ wireline cables are referred to as wireline tools.

A wireline toolstring may include a series of sensors, devices and components as well as a number of wireline connectors. The wireline connectors may provide an electrical connection to a component, join one section of the wireline toolstring to another, or provide bending flexibility for the wireline toolstring. Bending flexibility may facilitate passage of the wireline toolstring through curved portions of a wellbore, may provide rotational flexibility such as a swivel, or may serve as a part of an acoustic sensor to provide acoustic signal attenuation.

Presently, many wireline connectors that provide for bending flexibility and acoustic attenuation may employ universal joints. The universal joints provide some degree of bending flexibility at connections. Universal joints have limited flexibility and are formed of a large number of parts, components, and connectors. The large number of components and connectors lead to increased costs and a reduction in an overall component lifetime. For all practical purposes, in most cases the universal joints are found to be the weakest link in tension and compression along the wireline toolstring. Therefore, the industry would be receptive to an articulating wireline component formed having a variable and wider range of degree of flexibility and formed from few components to save the time which is required to assemble, repair and maintain the component.

SUMMARY

An articulating wireline component includes a first integrally formed member having a base portion, a neck portion and a ball portion having a first diameter, and a second integrally formed member including a base section, a neck portion and a socket portion including an opening having a second diameter that is smaller than the first diameter. The ball portion is arranged in the socket portion and the second integrally formed member is formed from a solid material.

A resource recovery and exploration system includes a surface system, a downhole system including a string of downhole tubulars, and a wireline extending along the string of tubulars. The wireline includes an articulating wireline component including a first integrally formed member including a base portion, a neck portion and a ball portion having a first diameter, and a second integrally formed member including a base section, a neck portion and a socket portion including an opening having a second diameter that is smaller than the first diameter. The ball portion is arranged in the socket portion and the second integrally formed member is formed from a solid material.

BRIEF DESCRIPTION OF THE DRAWINGS

Referring now to the drawings wherein like elements are numbered alike in the several Figures.

DETAILED DESCRIPTION

Figure 1:
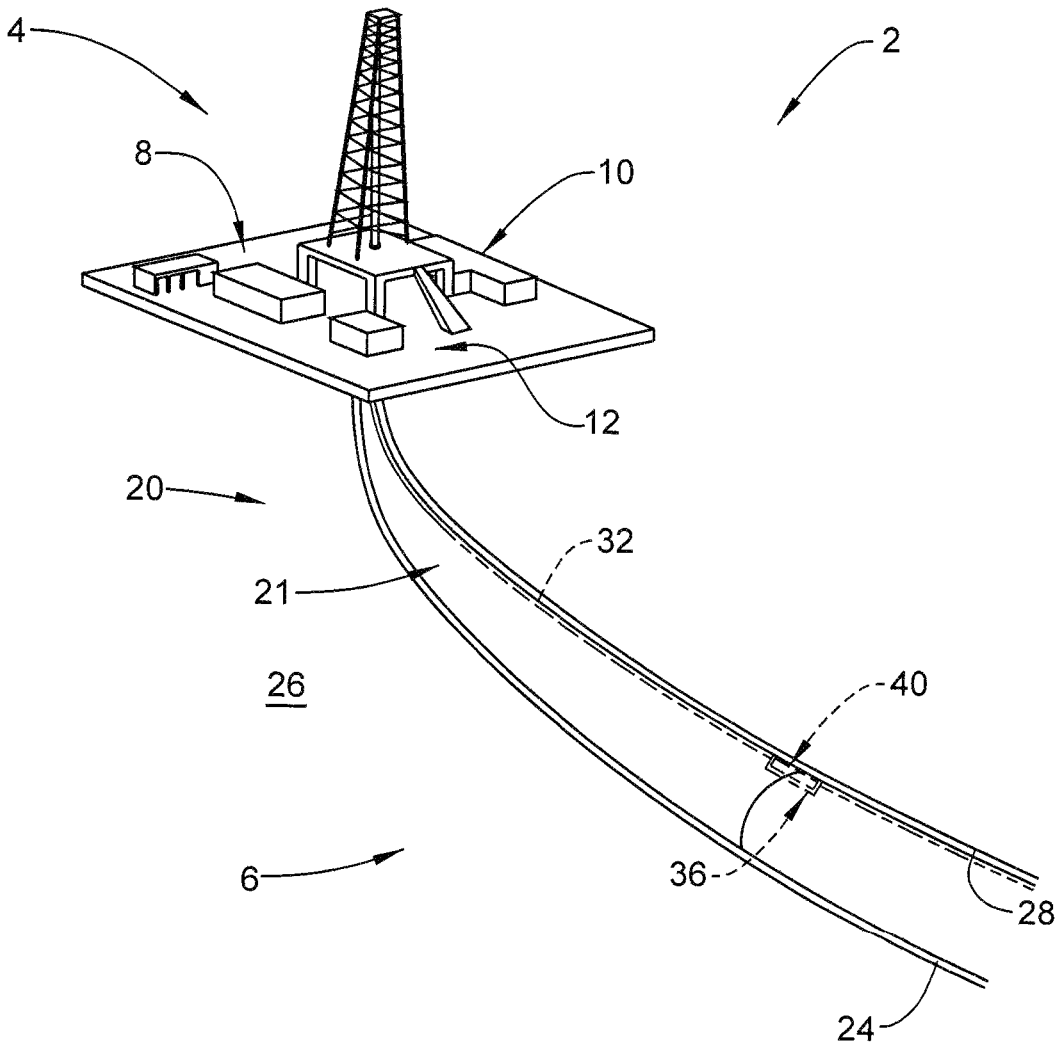
FIG. 1 depicts a resource recovery and exploration system including an articulating wireline component, in accordance with an exemplary embodiment.

A resource exploration and recovery system, in accordance with an exemplary embodiment, is indicated generally at 2, in FIG. 1. Resource exploration and recovery system 2 should be understood to include well drilling operations, resource extraction and recovery of formation fluids, $CO_2$ sequestration, and the like. Resource exploration and recovery system 2 may include a surface system 4 operatively and fluidically connected to a downhole system 6. Surface system 4 may include pumps 8 that aid in completion and/or extraction processes as well as fluid storage 10. Fluid storage 10 may contain a completions fluid, a stimulation fluid or other type of fluid which may be introduced into downhole system 6. Surface system 4 may also include a control system 12 that may monitor and/or activate one or more downhole operations.

Downhole system 6 may include a downhole string 20 formed from a plurality of tubulars, one of which is indicated at 21 that is extended into a wellbore 24 formed in formation 26. Wellbore 24 includes an annular wall 28. Downhole string 20 may include a wireline 32 that may extend from control system 12 downhole. Wireline 32 may include a wireline connector 36. Wireline 32 may include an articulating wireline component 40 that promotes freedom of wireline connector 36 as will be detailed herein.

Figure 2:
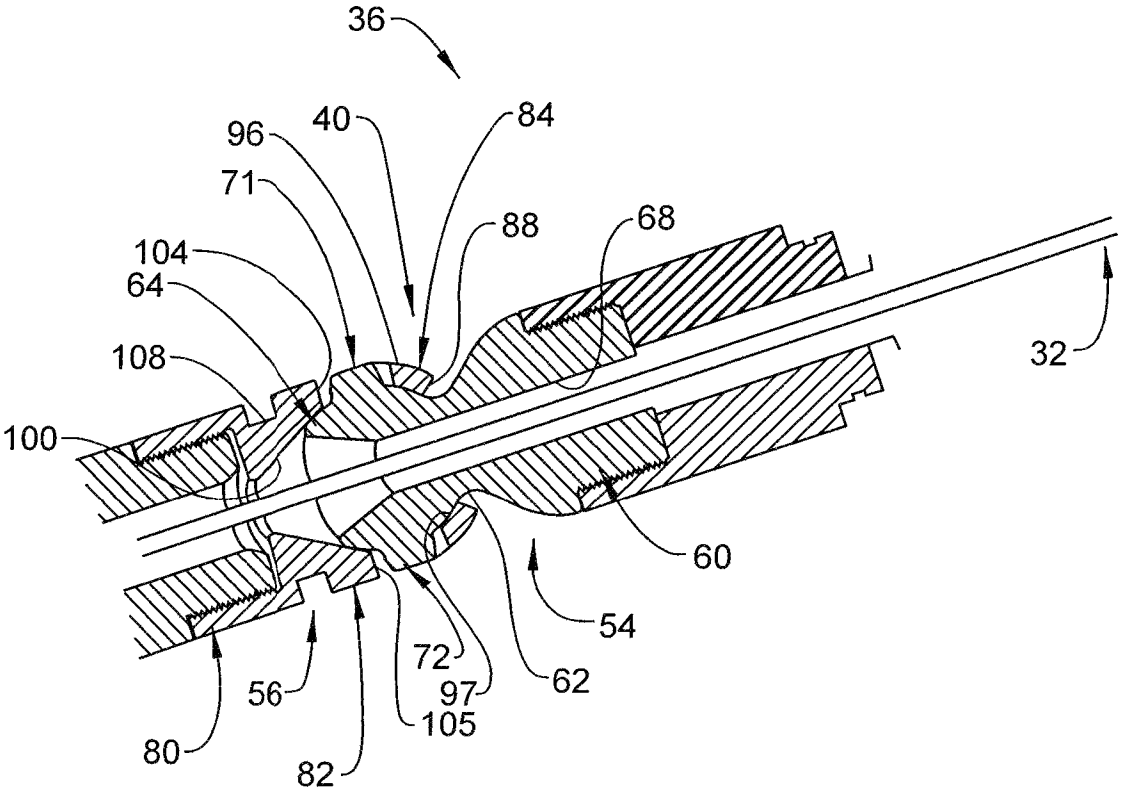
FIG. 2 depicts cross-sectional view of a wireline connector including an articulating wireline component, in accordance with an aspect of an exemplary embodiment.
Figure 3:
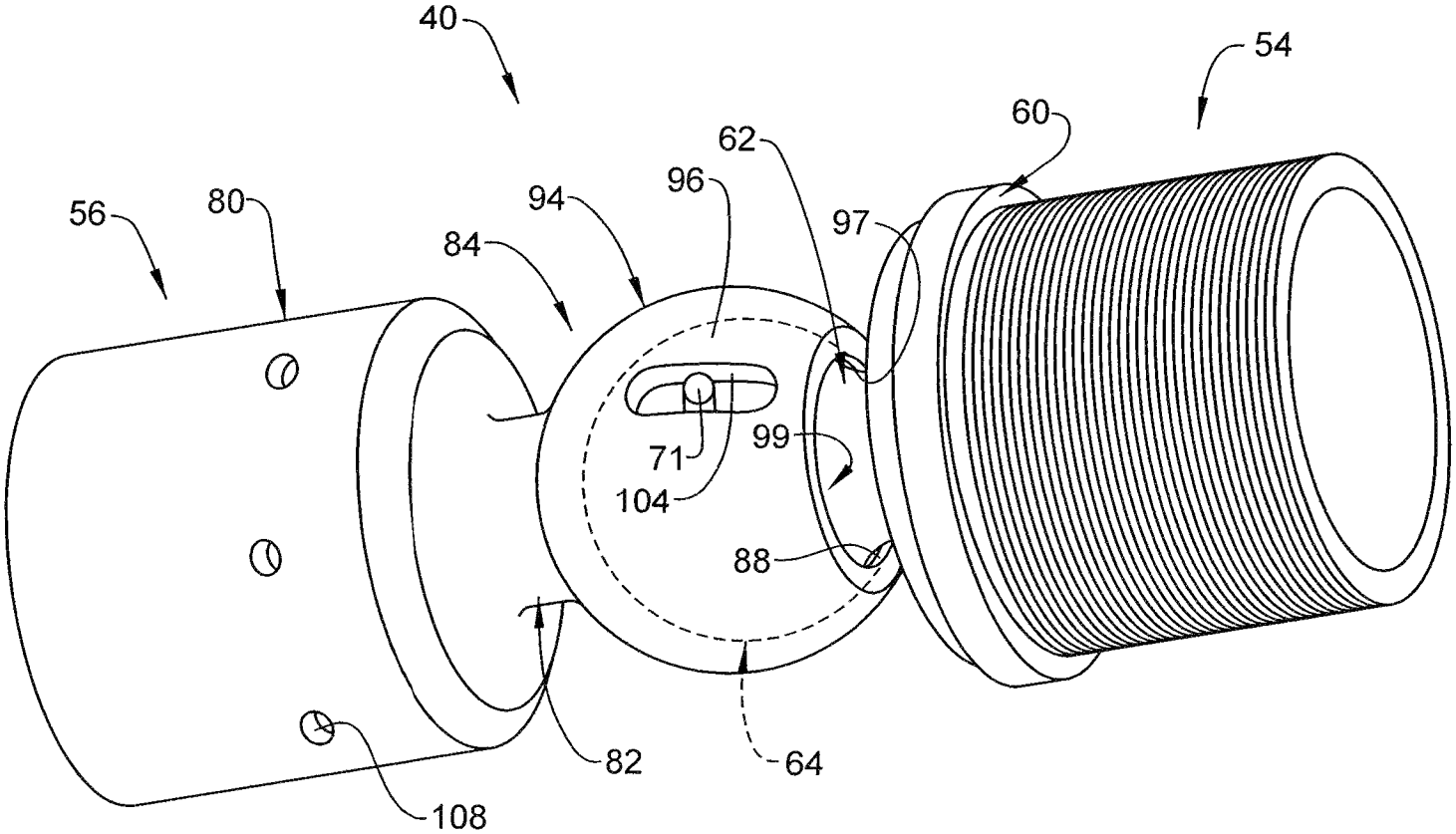
FIG. 3 depicts an articulating wireline component, in accordance with another aspect of an exemplary embodiment.

Referring to FIGS. 2-3 and with continued reference to FIG. 1, articulating wireline component 40 includes a first integrally formed member 54 and a second integrally formed member 56. First and second integrally formed members 54 and 56 are formed together through additive manufacturing techniques such as 3D printing, from a solid material such as steel. Of course, other solid materials may also be employed. It should be understood that the number of integrally formed members may vary depending upon a desired degree of flexibility. First integrally formed member 54 includes a base portion 60, a neck portion 62 and a ball portion 64 having a first diameter. Ball portion 64 may be substantially spherical as shown in FIG. 3 or may possess other shapes. For example, ball portion 64 may have a prolate spheroid shape. A passage 68 extends through first integrally formed member 54 and is receptive to wireline 32. In the exemplary embodiment shown, ball portion 64 is formed with a first pin 71 and a second pin 72. First and second pins 71, 72 are formed with ball portion 64. First and second pins 71 and 72 restrict relative rotation of first integrally formed member 54 and second integrally formed member 56. Base portion 60 may include a threaded portion (not separately labeled). The threaded portion may represent external or internal threads.

Second integrally formed member 56 includes a base section 80, a neck section 82 and a socket portion 84 having an opening 88. Opening 88 includes a second diameter that is smaller than the first diameter. Socket portion 84 includes an annular body 94 having an outer surface 96 and an inner surface 97 that defines a hollow interior 99. A passage 100 extends through second integrally formed member 56. Passage 100 registers with passage 68 to provide a conduit for wireline 32. Ball portion 64 is formed in hollow interior 99 or, in other words, annular body 94 is formed together with and about ball portion 64.

Annular body 94 may also include first and second openings 104 and 105 that extend from outer surface 96 through inner surface 97. First and second pins 71 and 72 are formed so as to extend or project into first and second openings 104, 105. First and second pins 71 and 72 interact with socket portion 84 to restrict relative rotation of first integrally formed member 54 and second integrally formed member 56 while still allowing for articulation. Base section 80 may be provided with a plurality of recesses 108 that are engaged by a tool to secure articulating wireline component to wireline connector 36. Similarly, base portion 60 may also include recesses.

Figure 4:
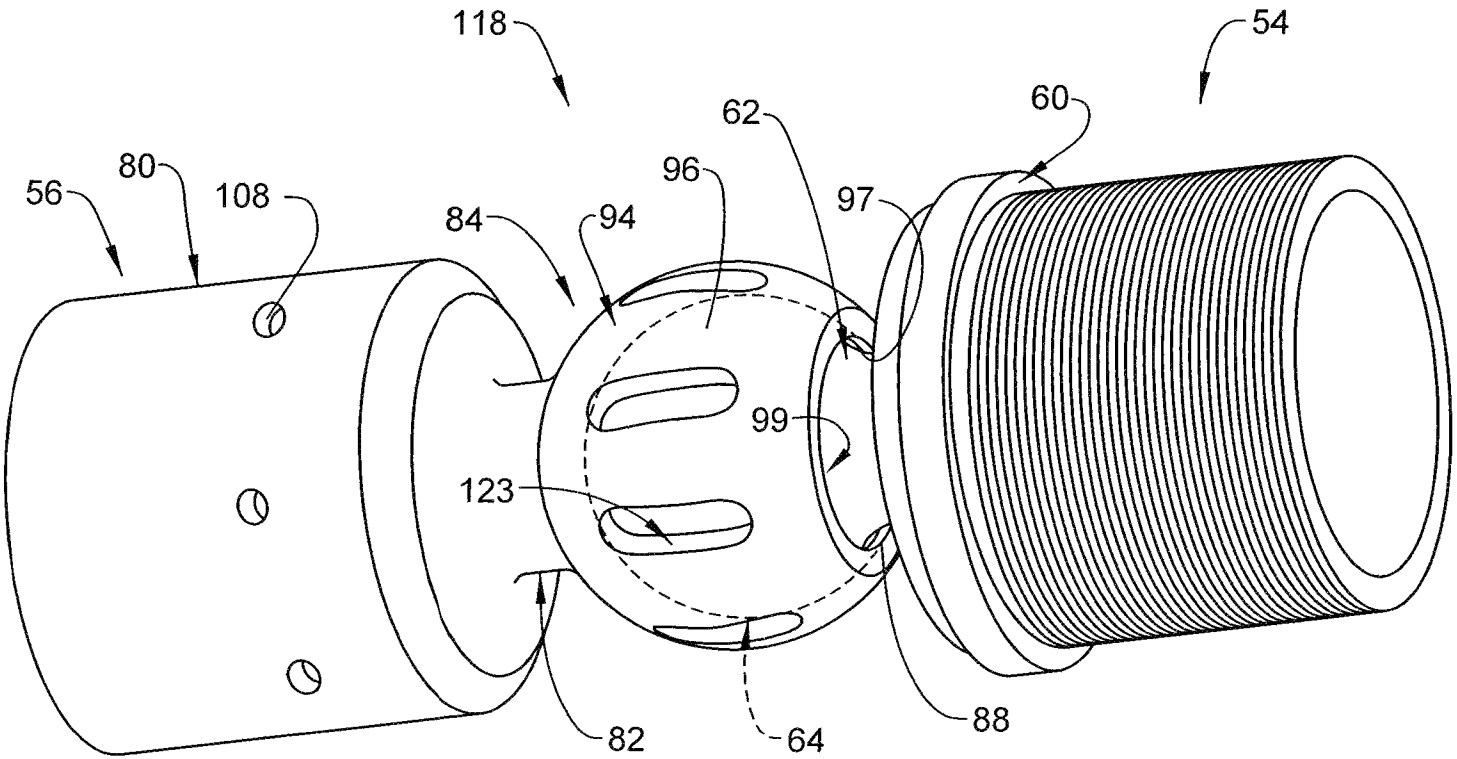
FIG. 4 an articulating wireline component, in accordance with yet another aspect of an exemplary embodiment.

Reference will now follow to FIG. 4, wherein like reference numbers represent corresponding parts in the respective views in describing an articulating wireline component 118, in accordance with another aspect of an exemplary embodiment. It should be understood that while shown without pins, ball portion 64 of articulating wireline component 118 may be formed pins if desired to restrict relative rotation of first integrally formed member 54 and second integrally formed member 56. In the event that relative rotation between first and second integrally formed members 54 and 56 is desired, ball portion 64 may be devoid of pins as shown in FIG. 4. Further, annular body 94 may be formed with a plurality of openings 123 that extend from outer surface 96 through inner surface 97. Openings 123 facilitate cleaning of articulating wireline component 40 after being arranged downhole.

Figure 5:
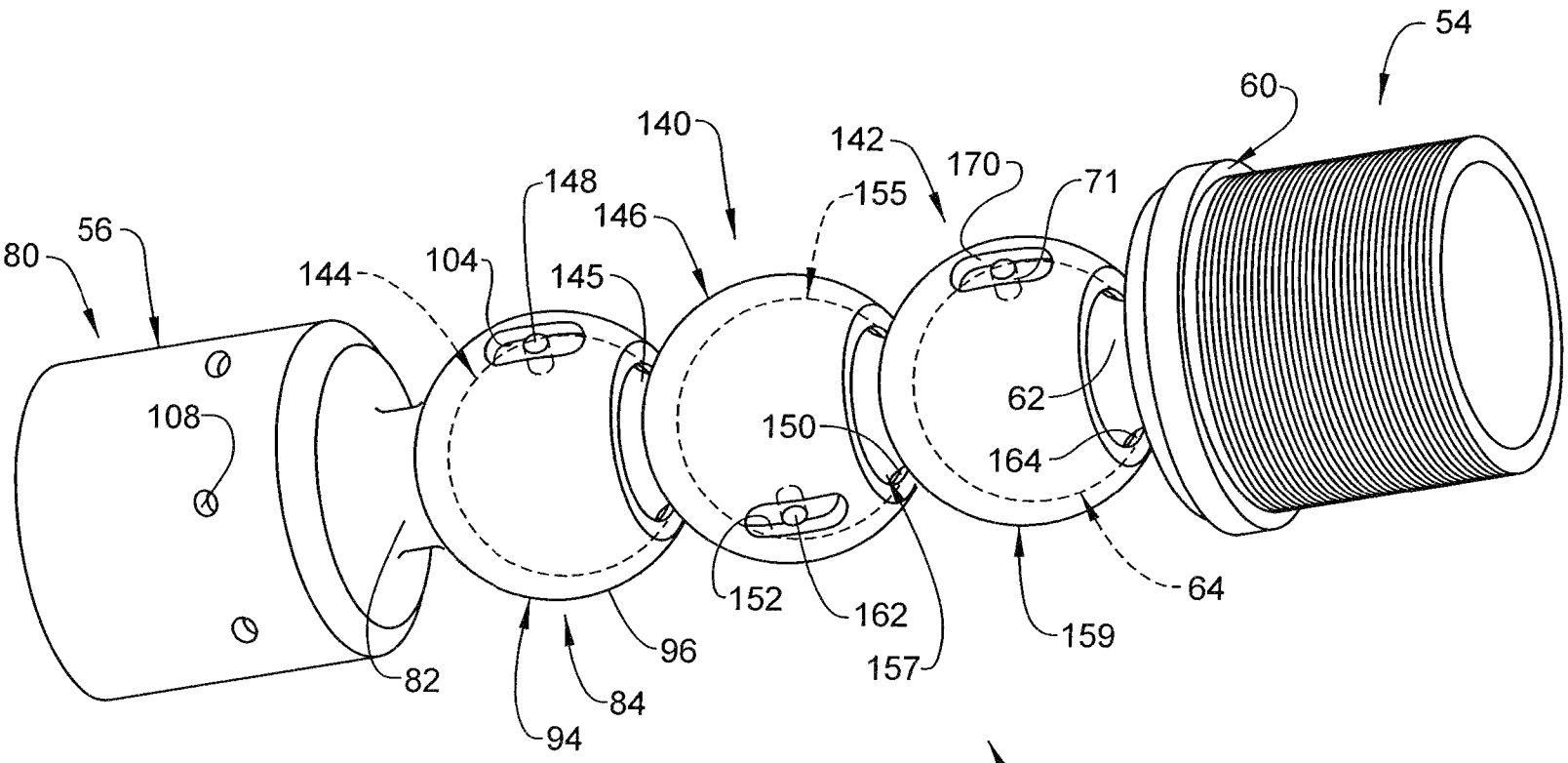
FIG. 5 depicts an articulating wireline component, in accordance with still yet another aspect of an exemplary embodiment.

Reference will now follow to FIG. 5, wherein like reference numbers represent corresponding parts in the respective views. First and second integrally formed members 54 and 56 may be combined with a third integrally formed member 140 and a fourth integrally formed member 142 to form an acoustic isolator 143. It should be understood that the number of integrally formed members combined to form acoustic isolator 143 may vary.

Third integrally formed member 140 includes a ball portion 144 having the first diameter, a neck portion 145 and a socket portion 146. Ball portion 144 may include one or more pins 148 and socket portion 146 may include an opening 150 having the second diameter and another opening 152. Ball portion 144 is formed together with socket portion 84. Fourth integrally formed member 142 includes a ball portion 155 having the first diameter, a neck portion 157 and a socket portion 159. Ball portion 155 may include a plurality of pins, one of which is shown at 162 and socket portion 159 includes an opening 164 having the second diameter. Pin 162 may extend through opening 152 formed in socket portion 146. Further, socket portion 159 is shown to include an opening 170 receptive of pin 71. Ball portion 155 is formed together with socket portion 146 and ball portion 64 is formed together with socket portion 159.

The use of, for example, additive manufacturing techniques to form the articulating wireline component leads to a direct reduction in parts needed to form a hinged downhole wireline element. Further, the use of additive manufacturing techniques provided greater flexibility of design thereby enabling formation of a joint having a selected range of articulation.

Set forth below are some embodiments of the foregoing disclosure:

Embodiment 1

An articulating wireline component comprising a first integrally formed member including a base portion, a neck portion and a ball portion having a first diameter, and a second integrally formed member including a base section, a neck portion and a socket portion including an opening having a second diameter that is smaller than the first diameter, the ball portion being arranged in the socket portion and the second integrally formed member being formed from a solid material.

Embodiment 2

The articulating wireline component according to any prior embodiment, wherein the opening is coaxial with the neck section.

Embodiment 3

The articulating wireline component according to any prior embodiment, wherein the socket portion includes an annular body having an outer surface and an inner surface defining a hollow interior, at least one opening is formed in the annular body, the at least one opening extending from the outer surface through the inner surface.

Embodiment 4

The articulating wireline component according to any prior embodiment, wherein the first integrally formed member includes at least one pin extending outward of the ball through the at least one opening, the at least one pin being integrally formed with the ball.

Embodiment 5

The articulating wireline component according to any prior embodiment, wherein the at least one pin includes a first pin extending through a first opening in the socket and a second pin extending through a second opening of the socket, the first and second pins being integrally formed with the ball.

Embodiment 6

The articulating wireline component according to any prior embodiment, wherein the at least one opening defines a plurality of openings extending circumferentially about the annular body.

Embodiment 7

The articulating wireline component according to any prior embodiment, wherein at least one of the base portion and the base section includes a plurality of recesses.

Embodiment 8

The articulating wireline component according to any prior embodiment, wherein the second integrally formed member is additively manufactured with the first integrally formed member.

Embodiment 9

The articulating wireline component according to any prior embodiment, wherein the base section defines a ball section having the first diameter.

Embodiment 10

The articulating wireline component according to any prior embodiment, further comprising a third integrally formed member including another base section, another neck portion and another socket portion including an opening having a second diameter that is smaller than the first diameter, the ball section being arranged in the another socket portion.

Embodiment 11

A resource recovery and exploration system comprising a surface system, a downhole system including a string of downhole tubulars, a wireline extending along the string of tubulars, the wireline including an articulating wireline component comprising a first integrally formed member including a base portion, a neck portion and a ball portion having a first diameter, and a second integrally formed member including a base section, a neck portion and a socket portion including an opening having a second diameter that is smaller than the first diameter, the ball portion being arranged in the socket portion and the second integrally formed member being formed from a solid material.

Embodiment 12

The resource recovery and exploration system according to any prior embodiment, wherein the opening is coaxial with the neck section.

Embodiment 13

The resource recovery and exploration system according to any prior embodiment, wherein the socket includes an annular body having an outer surface and an inner surface defining a hollow interior, at least one opening is formed in the annular body, the at least one opening extending from the outer surface through the inner surface.

Embodiment 14

The resource recovery and exploration system according to any prior embodiment, wherein the first integrally formed member includes at least one pin extending outward of the ball through the at least one opening, the at least one pin being integrally formed with the ball.

Embodiment 15

The resource recovery and exploration system according to any prior embodiment, wherein the at least one pin includes a first pin extending through a first opening in the socket and a second pin extending through a second opening of the socket, the first and second pins being integrally formed with the ball.

Embodiment 16

The resource recovery and exploration system according to any prior embodiment, wherein the at least one opening defines a plurality of openings extending circumferentially about the annular body.

Embodiment 17

The resource recovery and exploration system according to any prior embodiment, wherein at least one of the base portion and the base section includes a plurality of recesses.

Embodiment 18

The resource recovery and exploration system according to any prior embodiment, wherein the second integrally formed member is additively manufactured with the first integrally formed member.

Embodiment 19

The resource recovery and exploration system according to any prior embodiment, wherein the base section defines a ball section having the first diameter.

Embodiment 20

The resource recovery and exploration system according to any prior embodiment, further comprising a third integrally formed member including another base section, another neck portion and another socket portion including an opening having a second diameter that is smaller than the first diameter, the ball section being arranged in the another socket portion.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The terms "about" and "substantially" are intended to include the degree of error associated with measurement of the particular quantity based upon the equipment available at the time of filing the application. For example, "about" and "substantially" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. An articulating wireline component comprising:

a first member having a one-piece construction, the first member including a base portion, a neck portion, a ball portion having a first diameter, and a first passage extending through the base portion, the neck portion, and the ball portion;

a second member having a one-piece construction, the second member including a base section, a neck section, a socket portion including a first opening having a second diameter that is smaller than the first diameter, and a second passage extending from the first opening through the socket portion, neck section and to a second opening in the base section, the second opening being fluidically connected to the first opening, the ball portion being arranged in the socket portion and the second member being formed from a solid material, wherein the socket portion includes an annular body having an outer surface, and inner surface, defining a hollow interior and a plurality of openings that do not include any additional elements located therein, the plurality of openings extending from the hollow interior through the outer surface circumferentially about the annular body; and a wireline extending through the first passage and the first and second openings of the second passage.

2. The articulating wireline component according to claim 1, wherein the opening is coaxial with the neck section.

3. The articulating wireline component according to claim 1, wherein at least one of the base portion and the base section includes a plurality of recesses.

4. The articulating wireline component according to claim 1, wherein the second member is additively manufactured with the first integrally formed member.

5. The articulating wireline component according to claim 1, wherein the base section defines a ball section having the first diameter.

6. The articulating wireline component according to claim 5, further comprising: a third member having a one-piece construction, the third member including another base section, another neck portion and another socket portion including an opening having a second diameter that is smaller than the first diameter, the ball section being arranged in the another socket portion.

7. A resource recovery and exploration system comprising:

a surface system;

a downhole system including a string of downhole tubulars;

a wireline extending along the string of tubulars, the wireline including an articulating wireline component comprising:

a first member having a one-piece construction, the first member including a base portion, a neck portion, a ball portion having a first diameter, and a first passage extending through the base portion, the neck portion, and the ball portion;

a second member having a one-piece construction, the second member including a base section, a neck section, a socket portion including a first opening having a second diameter that is smaller than the first diameter, and a second passage extending from the first opening through the socket portion, neck section and to a second opening in the base section, the second opening being fluidically connected to the first opening, the ball portion being arranged in the socket portion and the second member being formed from a solid material, wherein the socket portion includes an annular body having an outer surface, and inner surface, defining a hollow interior and a plurality of openings that do not include any additional elements therein extending from the hollow interior through the outer surface circumferentially about the annular body, wherein the wireline extends through the first passage and the first and second openings of the second passage.

8. The resource recovery and exploration system according to claim 7, wherein the opening is coaxial with the neck section.

9. The resource recovery and exploration system according to claim 7, wherein the at least one opening defines a plurality of openings extending circumferentially about the annular body.

10. The resource recovery and exploration system according to claim 7, wherein at least one of the base portion and the base section includes a plurality of recesses.

11. The resource recovery and exploration system according to claim 7, wherein the second member is additively manufactured with the first integrally formed member.

12. The resource recovery and exploration system according to claim 7, wherein the base section defines a ball section having the first diameter.

13. The resource recovery and exploration system according to claim 12, further comprising: a third member having a one-piece construction, the third member including another base section, another neck portion and another socket portion including an opening having a second diameter that is smaller than the first diameter, the ball section being arranged in the another socket portion.

* * * * *